United States Patent [19]

Kato

[11] Patent Number: 4,814,557

[45] Date of Patent: Mar. 21, 1989

[54] DOOR LOCK POSITION SENSOR

[75] Inventor: Yuichi Kato, Yokohama, Japan

[73] Assignee: Ohi Seisakusho Co., Ltd., Yokohama, Japan

[21] Appl. No.: 185,405

[22] Filed: Apr. 25, 1988

[30] Foreign Application Priority Data

Apr. 30, 1987 [JP] Japan ..... 62-104768

[51] Int. Cl.[4] ..... H01H 3/00

[52] U.S. Cl. ..... 200/61.64

[58] Field of Search ..... 200/61.62, 61.64, 61.46, 200/61.67, 61.81, 61.82, 61.72, 61.73, 61.74, 61.75, 336, 337

[56] References Cited

U.S. PATENT DOCUMENTS 3,857,001 12/1974 Quantz ..... 200/61.64
4,249,161 2/1981 Mohnhaupt ..... 200/61.64
4,468,545 8/1984 Slavin ..... 200/61.64

FOREIGN PATENT DOCUMENTS 61-22011 7/1986 Japan .
61-49471 10/1986 Japan .

*Primary Examiner*—Roy N. Envall, Jr.
*Attorney, Agent, or Firm*—Foley & Lardner, Schwartz, Jeffery, Schwaab, Mack, Blumenthal & Evans

[57] ABSTRACT

In a door lock having a housing and a latch plate which is pivotally connected to the housing through a pivot shaft, there is arranged a position sensor for detecting an angular position of the latch plate. The sensor comprises a rotary switch securely connected to the housing, the rotary switch having a rotating shaft which causes ON and OFF conditions of the switch upon rotation thereof; and a link mechanism operatively arranged between the rotating shaft and the pivotal latch plate so that the pivotal movement of the latch plate induces a simultaneous pivotal movement of the rotating shaft of the switch. The rotary switch is placed at a position other than a position where an axis of the pivot shaft is placed.

12 Claims, 2 Drawing Sheets

DOOR LOCK POSITION SENSOR

BACKGROUND OF THE INVENTION

1. Field of the Invention

The present invention relates in general to a position sensor for sensing a position of a movable member, and more particularly to a position sensor which is installed in a door lock to sense or detect the position of a pivotal component of the door lock.

2. Description of the Prior Art

Nowadays, a so-called passive seat belt system has been proposed and put into practical use in the field of passenger motor vehicles, which is designed to automatically move a seat belt to a passenger restraining position when the vehicle door is closed.

For sensing the door closing, various sensors have been hitherto proposed, two of which will be outlined in the following in order to clarify the task of the invention. They are disclosed in Japanese Utility Model Second Provisional Publication No. 61-22011 and Japanese Patent Second Provisional Publication No. 61-49471, respectively.

In the former case, as is shown in FIG. 3 of the accompanying drawings, a micro switch "MS" is mounted in a door lock at a position above a latch plate "L". An actuating pin "A" of the switch "MS" is in contact with a peripheral side surface of the latch plate "L" as shown. Upon closing of the vehicle door, a striker "ST" secured to the vehicle body pushes back the latch plate "L" to the full-latch position as shown by a phantom line. During this, the peripheral side surface of the latch plate "L" moves and thus pushes the actuating pin "A" thereby causing ON or OFF condition of the switch "MS". With this, the open and close conditions of the door are detected.

In the latter case, a rotary switch is mounted outside of the door lock having its rotating shaft coaxially connected with a pivot shaft of the latch plate. Upon pivoting of the latch plate due to closing of the door, the rotating shaft is forced to pivot thereby causing ON or OFF condition of the rotary switch.

However, due to the inherent constructions, the above-mentioned conventional sensors have the following drawbacks.

That is, in the former case, the micro switch "MS" is easily affected by cold weather and dust. When, for example in winter, some parts of the switch "MS" are iced even weakly, the actuating pin "A" fails to closely follow the movement of the peripheral side surface of the latch plate "L". This causes malfunction of the switch "MS".

In the latter case, the entire construction of the door lock is bulky because of presence of the rotary switch coaxially mounted thereon. This makes installation of the door lock in the door difficult or at least troublesome. Furthermore, because the rotary switch is arranged outside of the door lock proper, it fails to have a satisfied resistance against water and dust.

SUMMARY OF THE INVENTION

It is therefore an object of the present invention to provide a door lock position sensor which is free of the above-mentioned drawbacks.

According to the present invention, there is provided, in a door lock having a housing, and a pivotal member pivotally connected to the housing through a pivotal shaft, an improved position sensor. The position sensor comprises a rotary switch securely connected to the housing, the rotary switch having a rotating shaft which causes ON and OFF conditions of the switch upon rotation thereof, and a link mechanism operatively interposed between the rotating shaft and the pivotal member so that a pivotal movement of the pivotal member induces a simultaneous pivotal movement of the rotating shaft of the rotary switch, wherein the rotary switch is placed at a position other than a position where an axis of the pivotal shaft of the pivotal member is placed.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
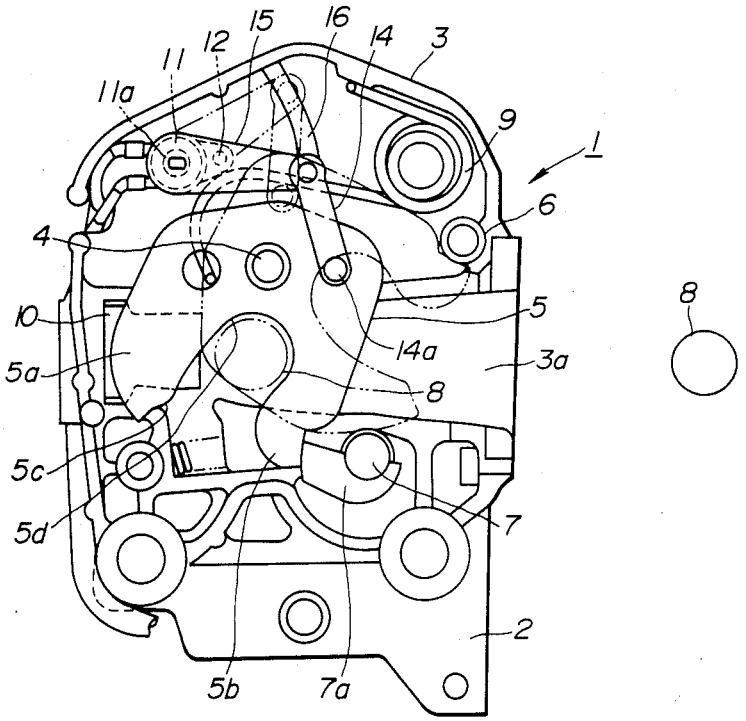
FIG. 1 is a front view of a door lock to which a position sensor according to the present invention is practically applied, with a cover plate removed for clarification of the interior of the door lock.

In the following, the words, "upward", "downward", "above", "below", "right", "left" and the like are to be understood with respect to the drawing on which the corresponding part is illustrated.

Figure 2:
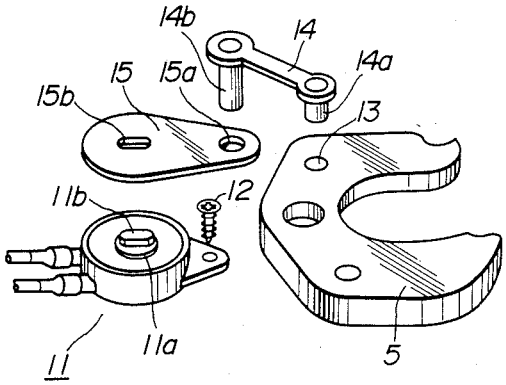
FIG. 2 is an exploded view of essential parts of the door lock position sensor.
Figure 3:
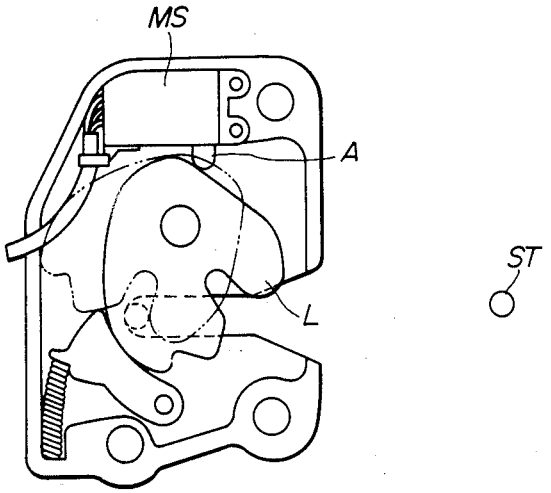
FIG. 3 (PRIOR ART)
FIG. 3 is a view similar to FIG. 1, but showing a conventional door lock position sensor.

Referring to FIGS. 1 and 2, particularly FIG. 1, there is shown a door lock 1 to which a position sensor according to the present invention is practically applied.

The door lock 1 comprises a base plate 2 on which a known latching and unlatching mechanism is mounted. In FIG. 1, the mechanism is placed behind the base plate 2 and thus the same is not viewed from this side. Denoted by numeral 3 is a plastic housing which houses therein essential parts of the door lock 1. A cover plate (not shown) is secured to the housing 3 through bolts, which conceals the interior of the housing 3.

The housing 3 is formed at its generally middle portion with a guide groove 3*a* into which a striker 8 secured to a vehicle body gets upon closing of the door. Designated by numeral 5 is a generally U-shaped latch plate which is pivotally held by a pivot shaft 4 which extends between the bottom of the housing 3 and the cover plate (not shown) above the guide groove 3*a*. The latch plate 5 is thus formed with first and second pawl portions 5*a* and 5*b* between which a recess 5*d* is defined. These first and second pawl portions 5*a* and 5*b* are exposed to the guide groove 3*a*.

Like a conventional door lock, the latch plate 5 can assume three particular positions, which are a release position as shown by a phantom line in FIG. 1, a full-latch position as shown by a solid line and a half-latch position (not shown) defined between the release and full-latch positions. When the latch plate 5 comes to the release position, the second pawl portion 5*b* thereof is brought into contact with a stopper 6 defined by the housing 3. In this condition, the door lock 1 is ready for receiving or catching the striker 8.

Below the guide groove 3*a*, there is arranged a shaft 7 which extends in parallel with the pivot shaft 4 of the latch plate 5. That is, the shaft 7 passes through the base plate 2, the bottom of the housing 3 and the cover plate and is rotatable about its axis. An arcuate pawl 7*a* is integrally connected to the shaft 7 to rotate therewith.

An open lever (not shown) is secured to the shaft 7 behind the base plate 2, so that the open lever and the pawl 7*a* rotate together. In response to operation of the open lever, the pawl 7*a* is latchingly engageable with the first and second pawl portions 5*a* and 5*b* of the latch plate 5 allowing the latch plate 5 to assume the above-mentioned three positions.

When the door is closed, the striker 8 on the vehicle body gets into the guide groove 3*a* and pushes back the latch plate 5 to the full-latch position (as shown by a solid line) getting over the second pawl portion 5*b*, wherein the latch plate 5 fully latches the striker 8 having the second pawl portion 5*b* thereof sustained by the pawl 7*a*. That is, in this full-latch position, a counterclockwise rotation of the latch plate 5 is suppressed.

When the door lock 1 assumes the half-latch position, the first pawl portion 5*a* of the latch plate 5 engages at its inboard side 5*c* with the pawl 7*a*. Under this condition, the striker 8 is halfly latched by the latch plate 5.

When, in response to rotation of the open lever (not shown), the pawl 7*a* is disengaged from a traveling way of the outermost free end (viz., the tops of the first and second pawl portions 5*a* and 5*b*) of the latch plate 5, the latch plate 5 is released from the pawl 7*a* thereby cancelling the full or half latched condition of the striker 8. Thus, the door is ready for opening. When thereafter the door is opened, the latch plate 5 is pivoted to the release position (as shown by the phantom line) due to a work of a biasing spring 9 which constantly biases the latch plate 5 in a counterclockwise direction in FIG. 1.

Designated by numeral 10 is a shock absorber which is placed at the inmost end of the guide groove 3*a* for softly stopping the striker 8.

The position sensor according to the present invention is installed in the door lock 1 in such a manner as will be described in the following.

Within the housing 3, there is disposed a rotary switch 11 which is placed near the shaft 4 of the latch plate 5. A screw 12 is used for detachably fastening the switch 11 to the housing 3.

As is best seen from FIG. 2, a link mechanism comprising first and second links 14 and 15 is arranged between the rotary switch 11 and the latch plate 5. The first link 14 has at its both ends shorter and longer pins 14*a* and 14*b* respectively, while, the second link 15 has at its both ends circular and rectangular openings 15*a* and 15*b* respectively. The longer pin 14*b* is pivotally engaged with the circular opening 15*a*, so that the two links 14 and 15 are pivotally movable relative to each other. The shorter pin 14*a* of the first link 14 is pivotally engaged with an opening 13 formed in the latch plate 5, while the rectangular opening 15*b* of the second link 15 is unmovably engaged with a rectangular projection 11*b* of a rotating shaft 11*a* of the rotary switch 11. As is seen from FIG. 1, the opening 13 is formed in an upper part of the second pawl portion 5*b* of the latch plate 5. Preferably, the rotating shaft 11*a* is arranged in parallel with the pivot shaft 4 of the latch plate 5. The detail of the rotary switch 11 will be described hereinafter. With the link mechanism as described in the above, it will be appreciated that the pivotal movement of the latch plate 5 causes a simultaneous pivotal movement of the rotating shaft 11*a* of the rotary switch 11. It is to be noted that when the latch plate 5 assumes the release position as shown by the phantom line in FIG. 1, the first and second links 14 and 15 define therebetween an acuate angle, while, when the latch plate 5 assumes the full-latch position as shown by the solid line, the two links 14 and 15 define therebetween an obtuse angle. Thus, the angular velocity of the second link 15 gradually increases when the latch plate 5 is pivoted in a direction from the release position to the full-latch position.

For smoothing the pivotal movements of the first and second links 14 and 15, an arcuate guide groove 16 is formed in the housing 3, to which groove a leading end of the longer pin 14*b* (viz., the end of the pin projected from the opening 15*a* of the second link 15) is slidably engaged. The groove 16 is concentric with the rotating shaft 11*a* of the rotary switch 11. With the provision of the concentric groove 16, the rotating shaft 11*a* of the rotary switch 11 is prevented from being forced radially outwardly during the pivotal movement of the latch plate 5. When the cover plate (not shown) is properly mounted on the housing 3, the inner surface of the cover plate approaches very closely to the first link 14 thereby preventing disjointing of the links 14 and 15 from their associated parts 5 and 11*a*.

The rotary switch 11 used in the invention is described in U.S. patent application No. 079,394 filed July 30, 1987 by the same applicant. The switch 11 is of a sealed rotary switch which is so designed that when the rotating shaft 11*a* is turned by a given angle, ON or OFF condition of the switch 11 is changed to the other condition. Of course, other sealed rotary switches are also usable in the invention.

When, with the construction as described hereinabove, the latch plate 5 is pivoted to the full-latch position as shown by the solid line in FIG. 1, the link mechanism causes the rotating shaft 11*a* of the rotary switch 11 to turn in a clockwise direction. With this, the switch 11 issues ON or OFF signal representing that the door is closed. When the latch plate 5 is pivoted from this full-latch position in a counterclockwise direction in FIG. 1, the link mechanism causes the rotary switch 11 to issue OFF or ON signal representing that the door is opened.

When the latch plate 5 is pivoted to the release position as shown by the phantom line, the link mechanism causes the rotating shaft 11*a* to turn in a counterclockwise direction by a given angle. With this, the rotary switch 11 issues OFF or ON signal representative of the opening of the door.

In the following, advantages of the present invention will be described.

First, since the pivotal latch plate of the door lock and the rotary switch are connected through a mechanically robust link mechanism, the movement of the latch plate is assuredly transmitted to the rotating shaft of the switch thereby achieving a high reliability of the position sensor. That is, even when some parts of the rotary switch are iced in winter or contaminated with dust, the rotating shaft of the rotary switch is assuredly rotated upon movement of the associated latch plate of the door lock.

Second, since the position sensor including the rotary switch and the link mechanism (or arm) is arranged in a manner to effectively use a space defined in the door lock, the door lock can be constructed compact in size. In fact, unlike the afore-mentioned conventional sensor arrangement wherein the rotary switch is coaxially arranged with respect to the pivotal shaft of the latch plate, the rotary switch is arranged beside the pivotal shaft of the latch plate in accordance with the present invention. This allows reduction in thickness of the entire construction of the door lock.

What is claimed is:

1. In a door lock having a housing and a pivotal member pivotally connected to said housing through a pivotal shaft, a position sensor comprising:

a rotary switch securely connected to said housing, said rotary switch having a rotating shaft which causes ON and OFF conditions of the switch upon rotation thereof, and a link mechanism operatively interposed between said rotating shaft and said pivotal member so that a pivotal movement of the pivotal member induces a simultaneous pivotal movement of said rotating shaft of the rotary switch, wherein said rotary switch is placed at a position other than a position where an axis of said pivotal shaft of the pivotal member is placed.

2. A position sensor as claimed in claim 1, in which an axis of said rotating shaft and the axis of said pivotal shaft are arranged in parallel with each other.

3. A position sensor as claimed in claim 2, in which said rotary switch is of a sealed type.

4. A position sensor as claimed in claim 3, in which said rotary switch is arranged in a concealed space defined in said housing of the door lock.

5. A position sensor as claimed in claim 4, in which said link mechanism comprises:

a first link having one end pivotally connected to said pivotal member of the door lock; and a second link connected at one end thereof to said rotating shaft of said rotary switch to move therewith, wherein the other end of said first link is pivotally connected to the other end of said second link.

6. A position sensor as claimed in claim 5, in which the pivotal connection between the other ends of said first and second links is made by:

means defining in the other end of said second link an opening; and a pin provided on the other end of said first link, said pin being rotatably put in said opening.

7. A position sensor as claimed in claim 6, in which a leading end of said pin is slidably received in a guide groove formed in said housing.

8. A position sensor as claimed in claim 7, in which said guide groove is curved concentric with said rotating shaft of said rotary switch.

9. A position sensor as claimed in claim 8, in which the pivotal connection between said pivotal member and said first link is made by:

means defining in said pivotal member an opening; and a pin provided on said first link, said pin being rotatably put in said opening.

10. A position sensor as claimed in claim 9, in which the connection between said second link and said rotating shaft of the rotary switch is made by:

means in said second link a rectangular opening; and a rectangular projection formed on said rotating shaft, said rectangular projection being unmovably engaged with said rectangular opening.

11. A position sensor as claimed in claim 10, in which said pivotal member is a latch plate of said door lock, said latch plate being movable in response to opening and closing of an associated door.

12. A position sensor as claimed in claim 11, in which said first link of said link mechanism is pivotally connected to a given portion of said latch plate, said given portion being positioned forward with respect to the pivoting shaft of the latch plate when said latch plate assumes its full-latch position.

* * * * *